US012024982B2

(12) United States Patent
Al Saleem et al.

(10) Patent No.: US 12,024,982 B2
(45) Date of Patent: Jul. 2, 2024

(54) PORTABLE ABSORBENT CONTAINER FOR RECOVERY OF OIL FIELD WASTE LIQUID

(71) Applicant: Saudi Arabian Oil Company, Dhahran (SA)

(72) Inventors: Khalid A. Al Saleem, Udhailiyah (SA); Ahmad Bassam AlArnous, Udhailiyah (SA); Abdulrahman G. Harthi, Hofuf Salmaniyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 417 days.

(21) Appl. No.: 17/510,872

(22) Filed: Oct. 26, 2021

(65) Prior Publication Data

US 2023/0127679 A1 Apr. 27, 2023

(51) Int. Cl.
*E21B 41/00* (2006.01)

(52) U.S. Cl.
CPC ..... *E21B 41/005* (2013.01)

(58) Field of Classification Search
CPC ..... E21B 41/005
See application file for complete search history.

(56) References Cited

U.S. PATENT DOCUMENTS 4,460,292 A * 7/1984 Durham ..... C02F 11/008 175/66
4,507,208 A * 3/1985 Simon ..... B01D 37/03 210/721
9,592,488 B2 3/2017 Yusuf et al.
2003/0006201 A1* 1/2003 Boutte ..... E21B 21/066 210/768
2007/0084866 A1 4/2007 Saeugling

FOREIGN PATENT DOCUMENTS

CN 203783576 U 8/2014
CN 205659440 U 10/2016
WO 2004083070 A1 9/2004

* cited by examiner

*Primary Examiner* — William D Hutton, Jr.
*Assistant Examiner* — Avi T Skaist
(74) *Attorney, Agent, or Firm* — Leason Ellis LLP

(57) ABSTRACT

A method and apparatus for collecting waste liquid at a wellhead from an above ground source conduit when wire-line apparatus and/or associated tools are withdrawn from a well includes providing a manually portable waste liquid containment assembly having a valved conduit subassembly that is connected in fluid-tight relation to the source conduit, and admitting waste liquid into the containment assembly at the drilling site. The waste liquid containment assembly includes a water and flame resistant cellulosic container fitted with a plurality of flexible oil and water impermeable polymer bags nested one inside of the other, the innermost polymer bag containing an oil-absorbent natural product. The valved conduit subassembly has components to safely control the waste liquid during the filling of the polymer bags, including a control valve, a check valve and a pressure relief valve. Conduit couplings join the conduits, which can include flexible sections, in fluid-tight mating relation.

17 Claims, 4 Drawing Sheets

PORTABLE ABSORBENT CONTAINER FOR RECOVERY OF OIL FIELD WASTE LIQUID

BACKGROUND OF THE INVENTION

Field of the Invention

This disclosure is directed to the recovery and removal of waste liquid in oil field operations at a wellhead to prevent hydrocarbon and other waste liquid contamination of the site and surrounding soil.

Description of Related Art

Wireline tools are specially designed instruments that can be lowered into a well bore on the end of A wireline cable. The tools are designed to collect and transmit data and to perform any number of particular services, such as evaluation of reservoir rock properties, the location of casing collars, formation pressures, information regarding the pore size or fluid identification and sample recovery. Modern wireline tools can be complex structures, and are engineered to withstand the harsh conditions found in modern oil, gas and geothermal wells.

In typical oilfield installations, the wireline is positioned on the ground in the vicinity of the wellhead and is wound around a large spool. Operators can use a portable spool mounted on the back of a special truck, or an apparatus that is a permanent part of the drilling rig. A motor and drive train, that includes a winch, turn the spool and raise and lower the attached tools and related equipment into and out of the well.

A complex array of conduits and valves for controlling the fluid flows into and out of the well-known as a christmas tree is secured to the wellhead. The wireline and tools are also admitted and retrieved via the christmas tree. After use, when the wireline tools are brought back to the surface, waste liquid that includes hydrocarbons, various chemical drilling additives and water drain from, and must be captured and removed from the site. Waste liquid present can be withdrawn from a section of the christmas tree via a dedicated conduit.

There is a need for an environmentally-friendly, efficient and economical way to capture and to dispose of the waste liquid that will prevent contamination of the surrounding soil.

SUMMARY OF THE INVENTION

The above needs are realized and other advantages are provided by the apparatus and method of the present disclosure that integrates a manually portable waste liquid containment assembly at a wellhead with an above ground source conduit to collect and store waste liquid that drains from wireline apparatus and/or associated tools when they are withdrawn from the well.

In an embodiment, the present disclosure is directed to a method of collecting the waste liquid at a wellhead produced from an above ground source conduit when wireline apparatus and/or associated tools are withdrawn from a well, the method comprising:

a. providing a manually portable waste liquid containment assembly;

b. connecting the waste liquid containment assembly in fluid-tight relation to the source conduit; and c. admitting waste liquid into the containment assembly at the drilling site, where the waste liquid containment assembly comprises:

(i) a water and flame resistant cellulosic container having a top surface in which an inlet port is formed, (ii) a plurality of flexible oil and water impermeable polymer bags nested one inside of the other positioned in the cellulosic container, the volumetric capacity of the polymer bags corresponding to the volume of the interior of the cellulosic container, the polymer bags having an inlet opening configured and dimensioned to receive waste liquid, (iii) an oil-absorbent natural product that is sterilized bird feathers and/or dried palm tree particles, positioned in the innermost polymer bag, and (iv) a valved conduit subassembly for admitting waste liquid into the interior of the innermost polymer bag through the opening in the top surface of the cellulosic container, the valved conduit subassembly comprising:

1) a length of conduit having a proximal end defining an inlet port that is configured to mate in fluid-tight relation to the source conduit for the passage of waste liquid, 2) a distal end defining a discharge port that is secured in fluid-tight relation to the inlet opening in the polymer bags, 3) a check valve for passing waste liquid from the inlet port to the discharge port and preventing back flow of waste liquid from the polymer bags, and 4) a pressure relief valve for venting gases from the polymer bags when the pressure exceeds a predetermined pressure, e.g., of 10 psi.

In another embodiment, the present disclosure is directed to the manually portable waste liquid containment assembly.

Other aspects, benefits, and advantages of these exemplary embodiments, are described in detail below, and still others will be apparent to those of ordinary skill in the art from this description.

Moreover, it is to be understood that both the foregoing information and the following detailed description are merely illustrative examples of various aspects and embodiments, and are intended to provide an overview or framework for understanding the nature and character of the claimed aspects and embodiments. The accompanying schematic drawings are included by way of illustration and to promote a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The method, system and apparatus of the disclosure will be described in more detail below and with reference to the attached drawings in which the same number is used for the same or similar elements, and where.

DETAILED DESCRIPTION OF PREFERRED EMBODIMENTS

The method and system for the collection of waste liquid produced when wireline tools are recovered at the wellhead will be described with reference to FIGS. 1A, 1B, 2, and 3 where there is shown the manually portable waste liquid containment assembly 100 that includes a water and flame resistant cellulosic container 110 which in the embodiment illustrated, is a corrugated cardboard box of substantially conventional configuration having a top surface in which an inlet port 112 is formed. In some embodiments, the cellulosic container 110 has a capacity of at least 20 liters. In some embodiments, the cellulosic container 110 is a fiber drum fitted with a top cover in which an inlet port 112 is formed. In a preferred embodiment, the cellulosic container is made of recyclable materials, and/or is reusable.

Figure 1A:
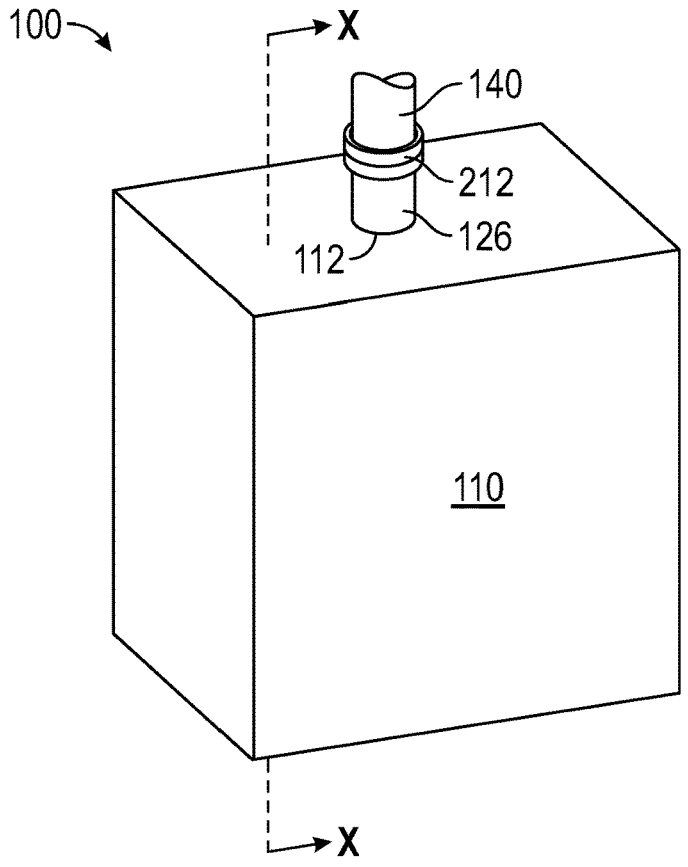
FIG. 1A is a top front and side perspective view of a manually portable waste liquid containment assembly of the present disclosure.
Figure 1B:
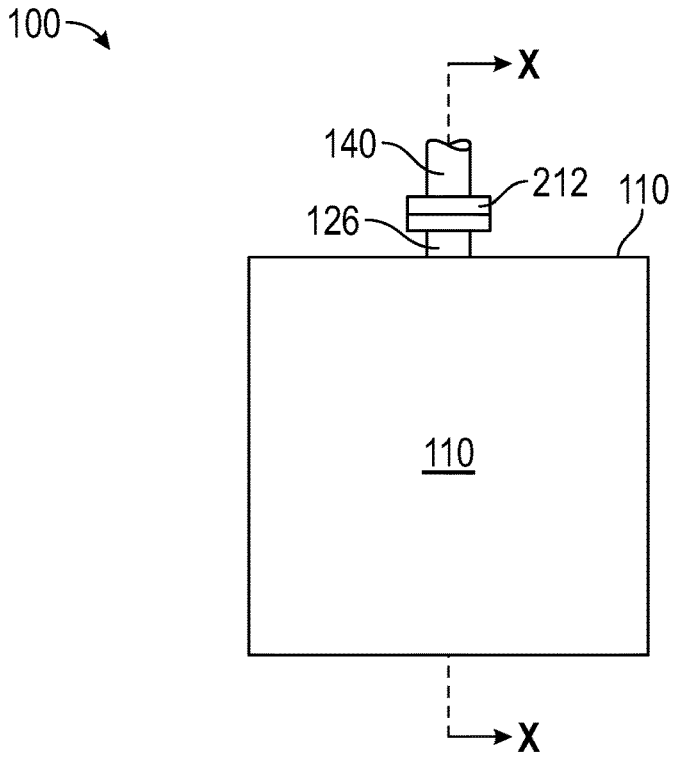
FIG. 1B is a side elevation view of a manually portable waste liquid containment assembly of the present disclosure.
Figure 2:
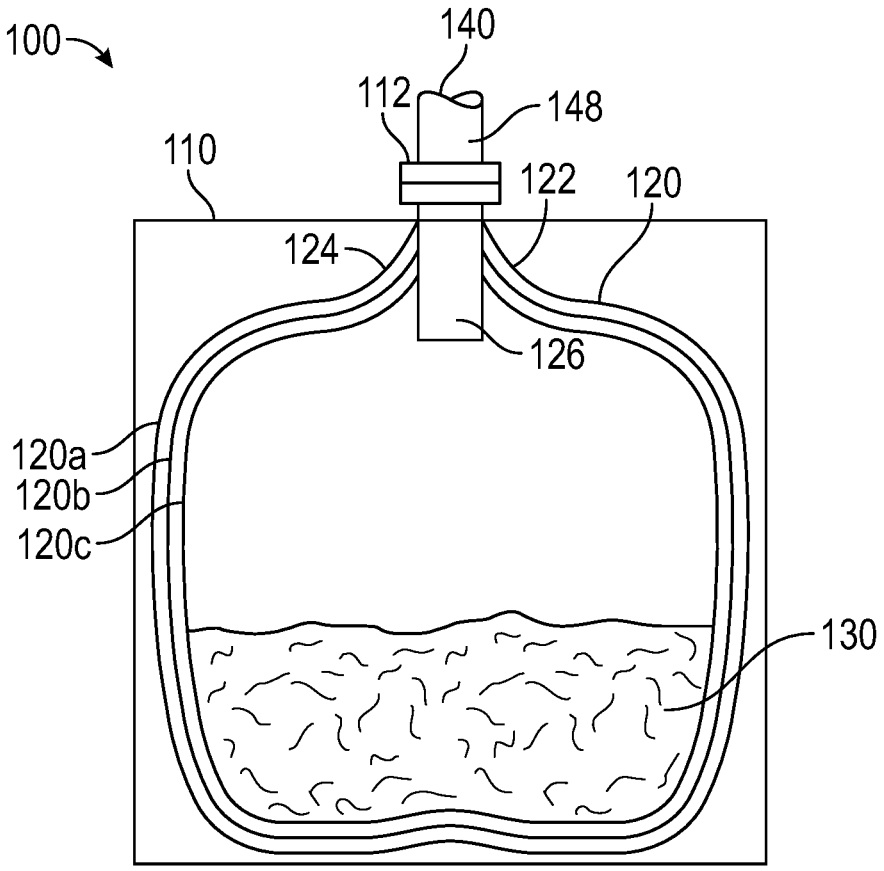
FIG. 2 shows a cross-sectional view of a manually portable waste liquid containment assembly of the present disclosure.
Figure 3:
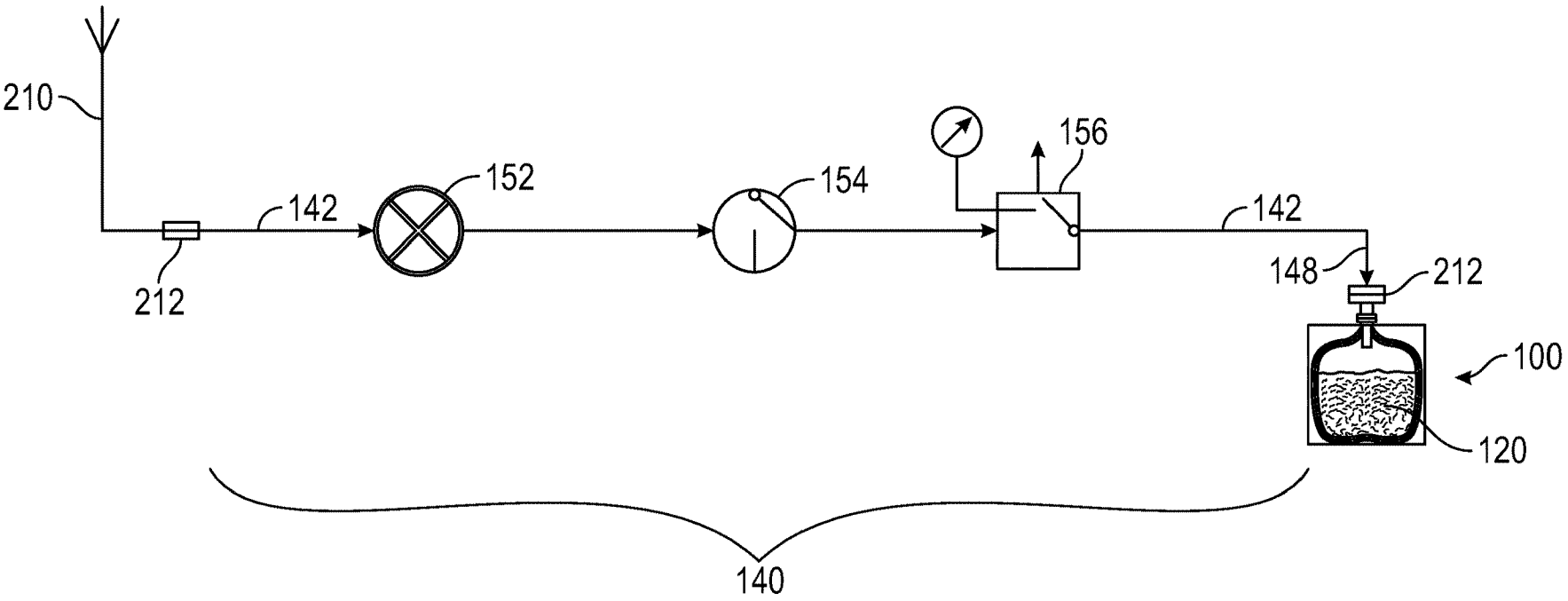
FIG. 3 is a schematic illustration of an embodiment of a valved conduit subassembly which forms part of this disclosure.

Containment assembly 100 includes a plurality of flexible oil and water impermeable polymer bags 120. The polymer bags 120 (shown in FIG. 2 as 120*a*, 120*b*, 120*c*) are nested one inside of the other, are positioned in the cellulosic container 110, and their volumetric capacity corresponds generally to the volume of the interior of the cellulosic container 110. In some embodiments, the polymer bags 120 are assembled from three separate heavy-duty polyethylene bags or are of a single unitary three-ply polymer construction. Each of the polymer bags 120 has a thickness about 50 microns. While FIG. 2 shows three polymer bags 120*a*, 120*b*, 120*c*, it will be understood that there can be any number of bags, with each embodiment having an outermost polymer bag 120*a* and an innermost polymer bag 120*c*.

The inlet openings 122 of the polymer bags 120 are configured and dimensioned to receive and admit the waste liquid. The polymeric composition of the polymer bags selected is resistant to degradation by hydrocarbons and other chemicals present in the waste liquid, for at least the period of time contemplated before final disposal has been completed.

In a preferred embodiment, a resealable container conduit 126 is provided in the inlet port 122 to which the polymer bags are heat-sealed or mechanically clamped at the discharge end, the opposite end being provided with a conduit coupling that mates with a coupling on the distal end of the delivery conduit 142.

The innermost polymer bag 120*c* is filled with an oil-absorbent natural product 130. In some embodiments, the oil-absorbent natural product is sterilized bird feathers and/or dried date palm tree particles. Suitable date palm tree particles are described in USP 9.592,488 B2, the disclosure of which is incorporated herein by reference. In a preferred embodiment, the oil-absorbent natural product absorbs a volume of waste liquid in the range of from about 10 L to about 20 L. A consideration is selecting the capacity of the cellulosic container is its final filled weight as it effects its manual portability.

Liquid waste containment assembly 100 includes valved conduit subassembly 140 that is configured and dimensioned to admit waste liquid into the interior of the innermost polymer bag 120*c* through the opening 112 in the top surface of the cellulosic container 110. Valved conduit subassembly 140 includes a length of conduit 142 having a proximal end 144 defining an inlet port 146 that is configured to mate in fluid-tight relation to an above ground source conduit for the passage of waste liquid from the christmas tree, and a distal end 148 defining a discharge port 150 that is connected in fluid-tight relation to the inlet opening 122 in the polymer bags 120. A portion of the polymer bags 120 defining the inlet opening are preferably heat-sealed or mechanically clamped to the distal end of the conduit 148. A check valve 152 is positioned in conduit 140 for passing waste liquid from the inlet port 146 to the discharge port 150 and preventing back flow of waste liquid from the polymer bags 120. A pressure relief valve 154 is positioned in fluid communication on conduit 140 to vent gases from inside the polymer bags when the pressure exceeds a predetermined pressure of, for example, 10 psi.

In a preferred embodiment, the flow of waste liquid is controlled by a shut-off or control valve 156 that is integral to the valved conduit subassembly 140. The control of the shut-off valve 156 can be automated with a valve actuator (not shown) which responds to signals from a volumetric flow meter and/or a weight sensor (not shown). In some embodiments, the polymer bags 120 are filled with waste liquid to a weight of about 18 kg by operation of the shut-off valve 156. In some embodiments, the waste liquid is admitted until from about 10 L to about 20 L is absorbed by the adsorbent natural product 130. In a preferred embodiment, the filled container remains manually portable.

Figure 4:
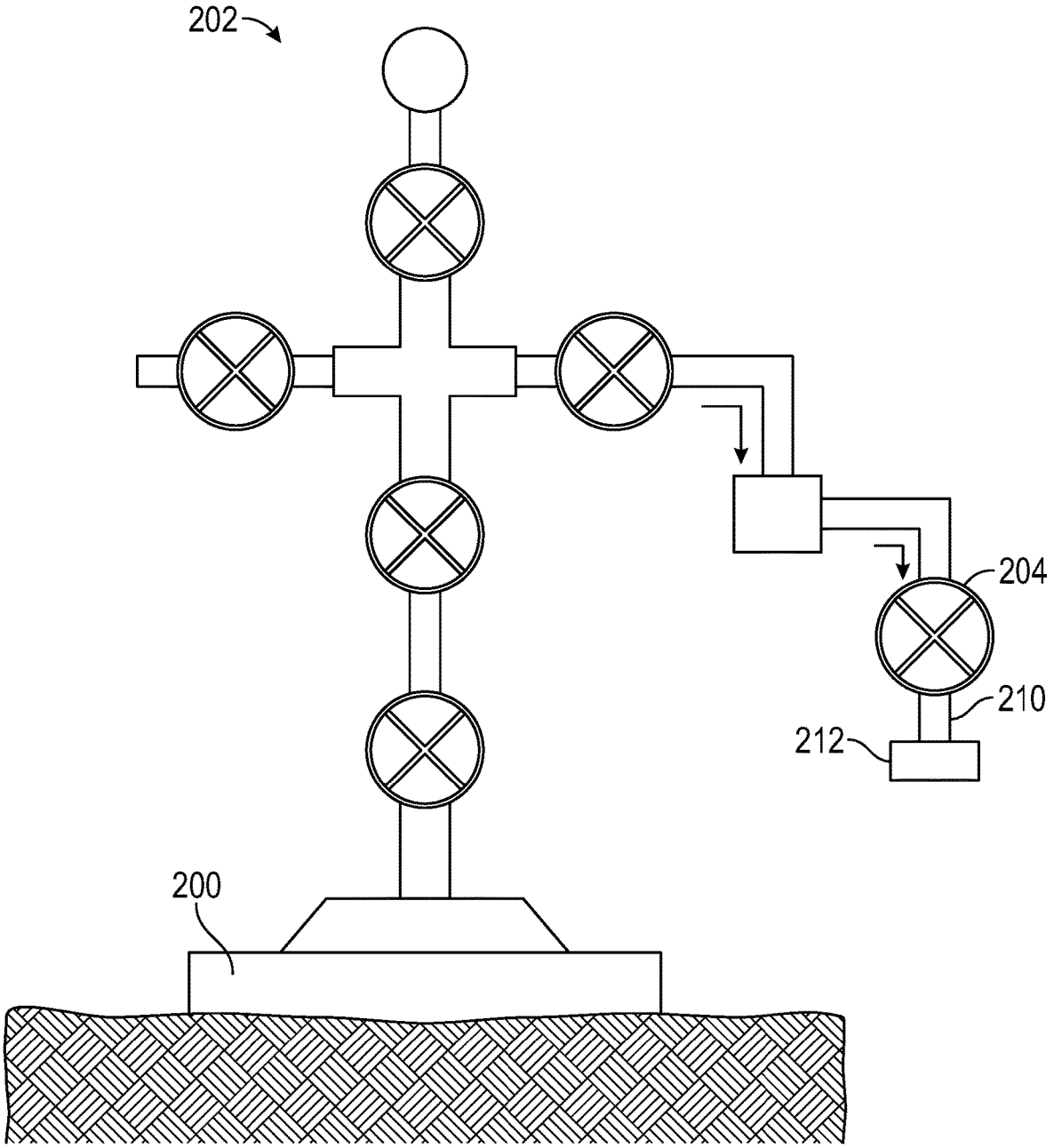
FIG. 4 is a generalized schematic view of a typical oil field christmas tree installation fitted with a source conduit in accordance with the present disclosure for the recovery of waste liquid following removal of wireline tools.

Referring now to FIG. 4, there is schematically illustrated an oil field christmas tree 202 that is installed on the wellhead 200 that is connected to the downhole piping. In this generalized illustration, a valved fitting 204 controls the flow of waste liquid to source conduit 210 that terminates in a source conduit coupling 212 of conventional design. This coupling and others referred to are preferably of the type referred to, and that functions as quick release couplings.

In the practice of the method of this disclosure, the liquid waste containment assembly as described above, is positioned in close proximity to the source conduit 210 and the delivery conduit 142 of the valved conduit subassembly 140 is connected in fluid-tight relation via mating conduit couplings 212 to the proximal end of the delivery conduit 142. The opposite distal end 148 of the delivery conduit is connected by means of appropriate couplings 212 to the inlet opening 122 of the polymer bags 120 that are prepositioned in the cellulosic container 110.

The valve fitting 204 on the christmas tree 202 is opened to permit the flow of waste liquid to the inlet port 146 of the delivery conduit 142 and shut-off valve 152 is opened to permit the flow into the polymer bags 120.

In a preferred embodiment, the liquid containment assembly is placed on a separate scale or other device having a display indicating the weight of waste liquid admitted into the cellulosic container. At a predetermined weight, the shut-off valve 152 is closed to prevent further flow. The weighing system can be automated by means that are well known in the art and signals are transmitted to a valve actuator which can slow and eventually close the valve entirely.

In an alternative embodiment, a flow meter is placed on the source conduit emanating from the christmas tree and similarly automated for control of the valved fitting 204 and/or the shut-off valve 152.

As will be apparent to one of ordinary skill, other control means can be provided and automated in order to minimize the number of personnel required to manage the collection and removal of waste liquid from the christmas tree conduit. The use of quick release couplings in this relatively low-pressure system enables the operator to quickly disconnect the valve conduit some assembly and seal the coupling attached to the polymer bags so that the cellulosic container can be filled to the desired capacity and manually moved to a nearby storage location or placed in a vehicle for transport to a final disposal site. A supply of the relatively lightweight empty cellulosic containers fitted with the polymer bags and a container conduit 126 can be stored at the site and quickly moved into position for attachment of the valved conduit subassembly, even while an adjacent container awaits removal. The filling operation can be facilitated further by the use of sections of flexible conduit attached to the source conduit. With this feature, the operation can be analogized to the flexible fill hose that is provided at a gasoline filling station that can be moved to begin filling an adjacent container.

In the method of the present disclosure for collecting waste liquid at a wellhead produced from an above ground source conduit when wireline apparatus and/or associated tools are withdrawn from a well includes providing the manually portable waste liquid containment assembly, connecting the manually portable waste liquid containment assembly in fluid-tight relation to the source conduit, and admitting waste liquid into the containment assembly at the drilling site. The manual portability permits the filled containment assembly to be removed quickly and replaced immediately to resume the collection of waste liquid without awaiting the dispatch of heavy equipment that would be required to lift and transport a filled conventional metal 55-gallon drum that are commonly used for waste disposal.

It will be understood from the above description that the method and system of the present disclosure provides an environmentally acceptable means for collecting waste liquid that are produced when wireline tools are brought up to the surface at a wellhead to prevent contamination of the site and surrounding soil. Once the waste liquid are collected by the system, they can be safely transported for disposal. Since the filled containment assembly is relatively lightweight, that is around 18 kg, it is easy to transport for disposal.

The method and system of the present invention has been described above and in the attached figures; modifications and variations to both the method and system/apparatus will be apparent to those of ordinary skill in the art from this description and the scope of protection is to be determined by the claims that follow.

The invention claimed is:

1. A method of collecting a waste liquid at a wellhead produced from an above ground source conduit when wireline apparatus and/or associated tools are withdrawn from a well, the method comprising:

a. providing a manually portable waste liquid containment assembly;

b. connecting the waste liquid containment assembly in fluid-tight relation to the source conduit; and c. admitting waste liquid into the containment assembly at the drilling site, where the waste liquid containment assembly comprises:

(i) a water and flame resistant cellulosic container having a top surface in which an inlet port is formed, (ii) a plurality of flexible oil and water impermeable polymer bags nested one inside of the other positioned in the cellulosic container, the volumetric capacity of the polymer bags corresponding to the volume of the interior of the cellulosic container, the polymer bags having an inlet opening configured and dimensioned to receive waste liquid, (iii) an oil-absorbent natural product that is sterilized bird feathers and/or dried palm tree particles, positioned in the innermost polymer bag, and (iv) a valved conduit subassembly for admitting waste liquid into the interior of the innermost polymer bag through the opening in the top surface of the cellulosic container, the valved conduit subassembly comprising:

1) a length of conduit having a proximal end defining an inlet port that is configured to mate in fluid-tight relation to the source conduit for the passage of waste liquid, 2) a distal end defining a discharge port that is secured in fluid-tight relation to the inlet opening in the polymer bags, 3) a check valve for passing waste liquid from the inlet port to the discharge port and preventing back flow of waste liquid from the polymer bags, and 4) a pressure relief valve for venting gases from inside the polymer bags when the pressure exceeds a predetermined pressure.

2. The method of claim 1 that includes controlling the flow of waste liquid from the source conduit by a shut-off valve that is integral with the valved conduit subassembly.

3. The method of claim 2 in which the operation of the shut-off valve is automated by a valve actuator which responds to signals from a volumetric flow meter, or a weight sensor, or both to which it is operably connected.

4. The method of claim 1 in which hydrocarbons are produced with the waste liquid.

5. The method of claim 1 in which the polymer bags positioned in the cellulosic container are assembled from three separate heavy-duty polyethylene bags or as a single unitary three-ply polymer sheet construction.

6. The method of claim 1 in which a portion of the polymer bags defining the opening are heat-sealed or mechanically clamped to a resealable container conduit coupled to the distal end of the valved conduit subassembly.

7. The method of claim 1 in which the water and flame resistant cellulosic container has a capacity of at least 20 L.

8. The method of claim 1 in which the oil-absorbent natural product absorbs a volume of waste liquid in the range of from 10 L to 20 L.

9. The method of claim 2 in which the polymer bags are filled to a weight of 18 kg by operation of the shut-off valve.

10. The method of claim 1 in which the waste liquid is admitted until from 10 L to 20 L is absorbed by the adsorbent natural product.

11. A manually portable liquid waste containment assembly for collecting a predetermined volume of hydrocarbon-containing waste liquid from a source conduit at an above-ground wellhead comprising:

a. a water and flame resistant cellulosic container having a top surface in which an inlet port is formed, b. a plurality of flexible oil and water impermeable polymer bags nested one inside of the other positioned in the cellulosic container, the volumetric capacity of the polymer bags corresponding to the volume of the interior of the cellulosic container, the polymer bags having an inlet opening configured and dimensioned to receive waste liquid, c. an oil-absorbent natural product that is sterilized bird feathers and/or dried palm tree particles, positioned in the innermost polymer bag, and d. a valved conduit subassembly for admitting waste liquid into the interior of the innermost polymer bag through the opening in the top surface of the cellulosic container, the valved conduit subassembly comprising:

(i) a length of conduit having a proximal end defining an inlet port that is configured to mate in fluid-tight relation to the source conduit for the passage of waste liquid, (ii) a distal end defining a discharge port that is secured in fluid-tight relation to the inlet opening in the polymer bags, (iii) a check valve for passing waste liquid from the inlet port to the discharge port and preventing back flow of waste liquid from the polymer bags, and (iv) a pressure relief valve for venting gases from inside the polymer bags when the pressure exceeds a predetermined pressure.

12. The portable liquid waste containment assembly of claim 11 in which the valved conduit subassembly includes a shut-off valve for controlling the flow of waste liquid from the source conduit.

13. The portable liquid waste containment assembly of claim 11 in which the cellulosic container is a corrugated cardboard box or a covered fiber drum.

14. The waste liquid containment assembly of claim 11 in which the polymer bags positioned in the cellulosic container are assembled from three separate heavy-duty polyethylene bags placed one inside the other or as a single unitary three-ply polymer sheet construction.

15. The waste liquid containment assembly of claim 11 in which a portion of the polymer bags defining the opening are heat-sealed or mechanically clamped to the distal end of the valved conduit assembly.

16. The waste liquid containment assembly of claim 11 in which the water and flame resistant cellulosic container has a liquid volumetric capacity of at least 20 L.

17. The waste liquid containment assembly of claim 11 in which the oil-absorbent natural product has a volumetric absorbent capacity of waste liquid in the range of from 10 L to 20 L.

* * * * *